United States Patent [19]

Dally

[11] 4,031,676

[45] June 28, 1977

[54] WATER BLOCKING DEVICE

[76] Inventor: Don A. Dally, P.O. Box 181, Pillager, Minn. 56473

[22] Filed: Mar. 29, 1976

[21] Appl. No.: 671,361

[52] U.S. Cl. ..... 52/102; 61/29
[51] Int. Cl.[2] ..... E02D 27/00
[58] Field of Search ..... 61/30, 29; 52/102

[56] References Cited

UNITED STATES PATENTS

| | | | |
|---|---|---|---|
| 3,398,539 | 8/1968 | Fore | 61/30 X |
| 3,745,701 | 7/1973 | Marvin | 52/102 X |

*Primary Examiner*—Price C. Faw, Jr.
*Assistant Examiner*—Carl D. Friedman
*Attorney, Agent, or Firm*—Clarence A. O'Brien; Harvey B. Jacobson

[57] ABSTRACT

A water blocking device mainly for the use on the interior of buildings and the like, but also usable outside thereof comprises a triangular-shaped structure in two shapes which may be interlocked to form small dam-like barriers. The primary structure is straight and formed with tongue and groove ends with one tongue being interlockable with the groove of the adjacent section. The second shape being that of a 45° curve again with the tongue and groove interlocking end portions. On the bottom surface of both type sections, recessed disc portions are provided to form in effect a plurality of miniature suction cups. Thus, when two or more of these structures are interlocked together and appropriately fastened to a smooth surface such as provided by a floor of a building, a quickly removable and interchangeable semi-permanent dam structure will be formed.

8 Claims, 4 Drawing Figures

WATER BLOCKING DEVICE

BACKGROUND OF THE INVENTION

1. Field of the Invention

This invention relates generally to temporary dams and wall structures for controlling surface water primarily within the interiors of buidings and the like, but also usable exteriorly thereof.

2. Description of the Prior Art

There are no known prior art devices usable within buildings for the purpose of this invention. However, there are a few temporary wall and dam-type devices used and known to be used on the ground exterior of buildings. None of these known devices offers the flexibility of the new and unique features of the disclosed invention.

A common problem with the known damming-type structures is that they are unduly complicated and difficult to assemble. Furthermore, they are bulky, heavy, and fairly difficult to assemble and use. With most of them some additional support structure or attachment structure is necessary in order to secure them to the earth or ground. With the known type having pointed attachment rods or prongs, some means of hammering or driving them into the ground is also required.

Also, known prior art devices are of straight configuration and are not readily adaptable to curved structures with a pleasing appearance. Crude and unpleasing structures outside of buildings may be entirely acceptable, but when used inside of structures, it is desirable that the structures not only be functionally useful but also aesthetically appealable. Known prior art patents which may be pertinent to this invention are as follows:

U.S. Pat. No. 627,375 — June 20, 1899 — Zanetti; U.S. Pat. No. 972,059 — Oct. 4, 1910 — Clarke; U.S. Pat. No. 1,013,610 — Jan. 2, 1912 — Pedley; U.S. Pat. No. 3,398,539 — Aug. 27, 1968 — Fore.

None of these known prior art devices offers the new and unique features of the invention disclosed herein.

SUMMARY OF THE INVENTION

An object of the present invention is to provide a semi-permanent water blocking device which may be used to direct and control flow of liquid within a building.

Another object of the present invention is to provide a water blocking device which has straight form and a curved form with each form provided with interlocking ends which engage each other and form a water-tight interlocking structure. This will permit either straight or curved blocking structure combinations for readily adapting the desired structure to the existing building arrangment.

A further object of this invention is to provide a water blocking device which is quickly and easily interlocked to block surface water within a building or exterior of a building and provided with suction cup type devices along the contact edge of the blocking devices for semi-permanently securing the blocking devices to the floor or other surfaces of said building.

Another further very important object is to provide the blocking sections with a special configuration which will tend to increase the holding power of the suction cup devices as the height of water being blocked increases, that is, the weight of water being blocked, which weight of water increases with the greater height of water behind the 37 dam", is used to effectively increase the holding power of the sections.

A still further object of this invention is to provide a readily removable and installable water blocking device which is completely water-tight once assembled and yet may be quickly disassembled for removal and transporting to another use point.

A further additional object of this invention is to provide water blocking structure made of rather soft yet flexible material which will readily conform to small surface irregularities and create a water-tightness therewith which is not available with structures of a rigid construction.

The water blocking structure of this invention consist of straight sections of basically triangular cross-sectional configurations with the sides tapering or sloping to create a water weight responsive surface along each side. Also, the structures have tongue and groove interlocking ends in order to present a continuous water-tight blocking surface. Also, the bottom floor or surface engaging portions of said triangular sections which are basically flat have disc suction cup type recesses therein to form a positive water blocking seal through suction cup type action with the surface with which the water blocking sections are used. A second shape provided and envisioned by this invention consists of approximately 45° angle sections having similar cross-sectional configurations as the straight sections. Also, as envisioned by this invention, complete semi-circle sections of 90° or even 180° may be supplied, if desired. Normally, however, the sections of straight type and 45° type will be adequate and sufficient to permit a user to construct and quickly build any type blocking dam or wall which the user may need or desire.

Another important feature of this invention is that the sections described above are made of material which is rather soft and yet firm for permitting the sections to conform to any slight surface irregularities in order to improve the water blocking action of the sections. A soft yet firm rubber material has been discovered to be very successful. Other type materials also may be used, such as the newer plastics, etc.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE PREFERRED EMBODIMENTS

Figure 1:
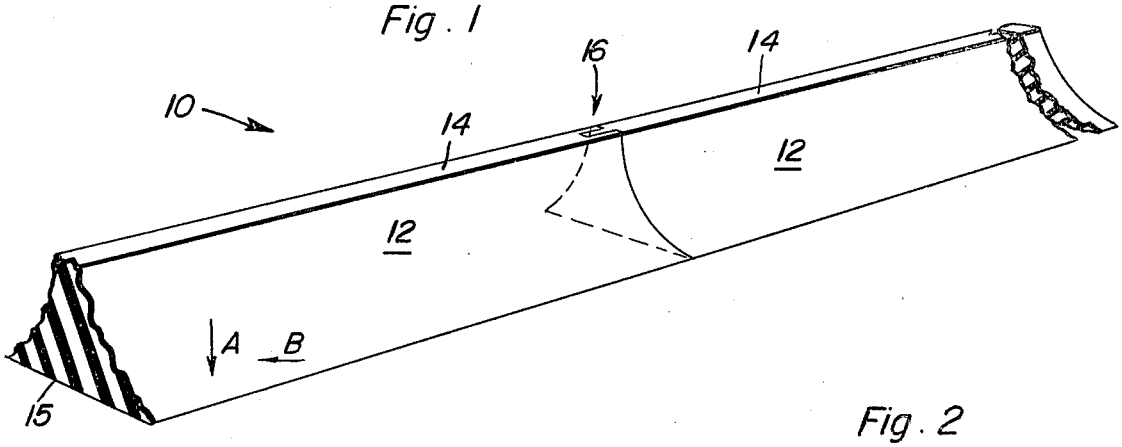
FIG. 1 is a perspective view of two of the straight sections of the water blocking device of this invention.

Referring to FIG. 1 of the drawings, reference numeral 10 indicates in general the water blocking structure of this invention. The structure of this invention consists of two basic type structures. One of the structures is of straight configuration having interlocking joints at the ends thereof and provided with suction cup type recesses along a bottom surface and the second type is of similar construction but of a semi-circular configuration of preferably 45°.

Looking at the figures, the basic common structure consists of slightly curved or tapered side walls 12 meeting at a flat top portion 14 and provided with a substantially wide bottom surface 15. This over-all configuration as viewed from the end thereof presents a generally triangular shaped device. However, the tapered sides do perform a very important function as described below. Interlocking joint means are provided at the ends of each of the structures for joining as shown by 16 in FIG. 1.

Figure 2:
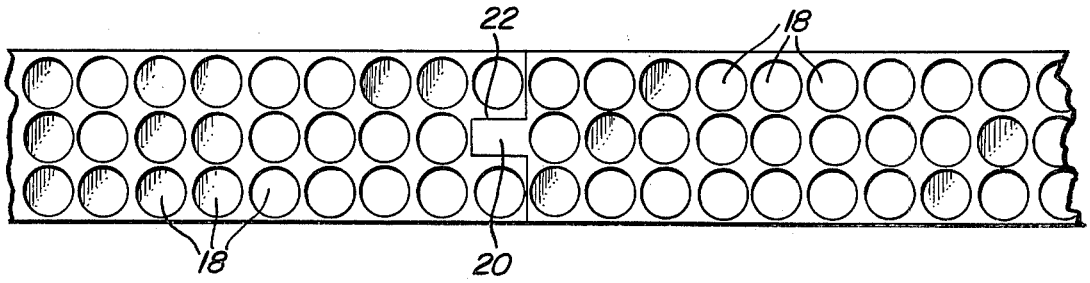
FIG. 2 is a bottom plan view of the water blocking sections of FIG. 1 showing the disc-type, suction cup recesses provided therein.
Figure 3:
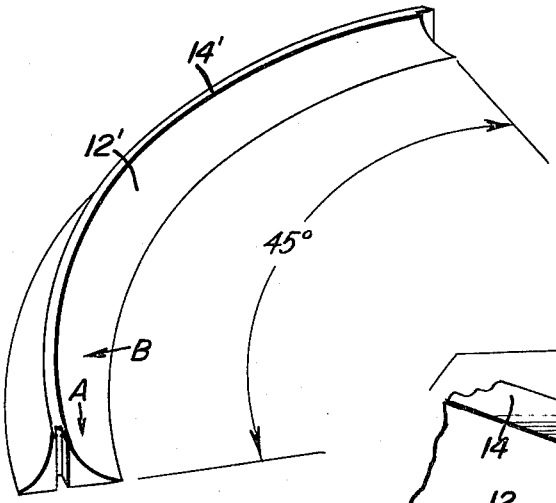
FIG. 3 is a perspective view of the curved type sections of water blocking device of this invention.

The basically flat bottom surface of the triangular sections, that is the surface 15, as best seen in FIG. 2, is provided with regularly spaced indentations or circular recesses 18. These circular recesses provide a suction cup type action when the unit is resting on a floor or other smooth surface and when the top edge 14 of the unit is pressed downwardly against the floor surface. As is well known with suction cup devices, once the suction cup effect takes place and a device is attached by this type attachment, the degree of attachment is rather strong and the pieces will tend to remain firmly attached until forcibly separated. Plus, in addition to this, the tapered sides 12 are of such a shape for the specific purpose of creating an additional force in the vertical direction A due to the weight of the blocked water than the horizontal force B caused by the same blocked water. Thus the weight of water being blocked will increase the hold of the suction cups as the height of the water increases. This is a very important feature of the structure of this invention.

Figure 4:
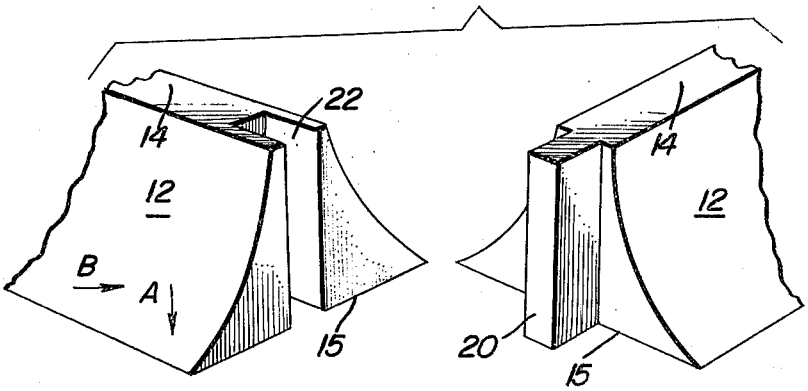
FIG. 4 shows an enlarged view, of the respective ends of the sections of FIG. 1 and show the tongue and groove interlocking joint thereof and the special shape of the sides of each section.

The joint 16 is formed by a tongue and groove type connection. FIG. 4 shows this manner of connection in enlarged detail. One end of each of the water blocking sections is provided with a tongue 20 while the other end of the same section is provided with a recess 22. Using this tongue and groove type connection, a number of the water blocking sections can be easily and quickly assembled. Some of the sections of the curved type, preferably will have the tongue and groove ends interchanged so that these sections may be used with the other sections for producing reverse curves, etc. With the straight sections, obviously, the section itself merely needs to be turned end for end in order to create the same result.

The sections described herein are normally made of soft, yet firm, rubber material or may be made from the new-type plastic materials, or any suitable material which is semi-resilient, yet fairly firm and, of course, water-resistant.

This water blocking device can be used to direct the flow of liquid to a certain area, or confine it, or whatever type of control of surface water is desired, as the case may be. For instance, as an example, a janitor may use this device as a holding unit at the bottom of a flight of stairs while he flushes down a stairwell with water. After completion of his flushing of the stairwell, the janitor may then proceed down stairs and use a hydrovac to suck up the water that the water blocking device of this invention has confined and contained at the base of the stairs. Obviously, this is very important because otherwise said water might flow into the furnace area or other area where damage could occur. The sections of water blocking structure of this invention are short and light enough that they may be easily carried as a bundle by the average janitor, and/or workman, and will, once used, become so helpful to the janitor or other worker that it will be no problem getting the person to use them on a continuous basis. Thus, in the case of building maintenance and cleaning the water blocking device of this invention will be extremely useful.

There are obviously many other very useful applications of a device such as that disclosed herein. The device also will be quite useful around swimming pools and patios and the like. Anywhere, either inside or outside of building structures where the over-all surface area is relatively smooth and where the surface area is such that the suction cups 18 will secure the devices will be suitable applications for the use thereof of this invention. Also, the feature of increased suction cup holding action effected by the special shape of the sides of the blocking sections is very useful.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of this invention.

What is claimed as new is as follows:

1. A surface water blocking device comprising; a self-supporting longitudinally extending section member having, first means for connection to another such section member in interlocking fashion to present a continuous barrier to the flow of surface water, second means for removably fastening each member to the surface on which they rest in a water-tight semi-permanent fashion, the first means for connecting one section member to another section member includes a tongue and groove joint, and the second means for removably fastening each section member to the surface includes suction cup type recesses provided in each section member.

2. The structure as set forth in claim 1, wherein at least one side of the section member is provided with a special shape to increase the holding action of the suction cup type recesses.

3. The structure as set forth in claim 2, wherein a plurality of section members are provided and connected to form a long continuous surface water blocking dam structure.

4. The structure as set forth in claim 3, wherein some of the plurality of sections are of curved configuration and others of the section members are of straight configuration.

5. The structure as set forth in claim 4, wherein some of the curved sections have the tongue and groove interlocking portions reversed with the respective ends thereof in order to form reverse curved blocking sections and at least one part of the over-all blocking dam.

6. A water blocking device comprising: section menas of basic triangular cross-section configuration having tapered sides and a flat bottom and of relatively long length in relationship to the flat bottom of the triangular cross-section, interlocking means at each end of the section means to form a watertight connection with another similar section means in order to complete a water blocking dam structure, and additional fastening and attaching means along the bottom portion of the triangular configured section means for semi-permanently securing each of the section means to the surface upon which they are being used, said section means are straight and other of the section means are of curved configuration, and the additional fastening and attachment means along the bottom surface of the section means includes suction cup type devices for positively attaching the section means to the surface structure.

7. The structure as set forth in claim 6, wherein the interlocking means at each end of the section means includes a tongue and groove type configuration with the tongue portion being provided at one end of a section means and the grooved recess to complement same being provided at the opposite end of the same section.

8. The structure as set forth in claim 7, wherein the tapered sides of the sections provide means for increasing the holding action of the suction cup type devices on the bottom as the height of the water being blocked increases.

* * * * *